United States Patent [19]

Matta

[11] Patent Number: 4,511,488

[45] Date of Patent: Apr. 16, 1985

[54] D-LIMONENE BASED AQUEOUS CLEANING COMPOSITIONS

[75] Inventor: Grant B. Matta, Dover, N.J.

[73] Assignee: Penetone Corporation, Tenafly, N.J.

[21] Appl. No.: 558,040

[22] Filed: Dec. 5, 1983

[51] Int. Cl.[3] ..... C11D 7/22

[52] U.S. Cl. ..... 252/162; 252/171; 252/174.21; 252/DIG. 14

[58] Field of Search ..... 252/162, 171, 174.21, 252/558, DIG. 14

[56] References Cited

U.S. PATENT DOCUMENTS

| | | | |
|---|---|---|---|
| 3,642,644 | 2/1972 | Grote et al. | 252/171 |
| 4,199,482 | 4/1980 | Renaud et al. | 252/DIG. 14 |
| 4,256,611 | 3/1981 | Egan et al. | 252/DIG. 14 |
| 4,336,152 | 6/1982 | Like et al. | 252/174.21 |
| 4,362,638 | 12/1982 | Caskey et al. | 252/162 |
| 4,414,128 | 11/1983 | Goffinet | 252/171 |
| 4,438,009 | 3/1984 | Brusky et al. | 252/174.21 |

*Primary Examiner*—Paul Lieberman
*Assistant Examiner*—Willie Thompson
*Attorney, Agent, or Firm*—Howard E. Thompson, Jr.

[57] ABSTRACT

D-Limonene-based aqueous cleaning compositions for hard and/or flexible substrates are provided wherein the normally water-immiscible d-limonene is stabilized in clear aqueous solution by the combined effect of carefully selected and proportioned surface active agents, and a coupling agent, suitably in the form of a glycol or a lower alkyl glycol ether. One or more surfactants can be employed with a glycol or glycol ether as the coupling agent. Preferred formulations contain selected anionic, nonionic, or mixed anionic-nonionic surfactants. The compositions can also contain small amounts of additives adapting the compositions to particular uses. The new cleaning compositions contain by weight, 78 to 96 parts of a d-limonene/surfactant/water mixture containing 10–60% d-limonene, 10–30% surfactant, and 20–70% water, coupling agent in the amount of 2–10 parts by weight, and 2–12 parts of additives adapting the compositions to particular uses. Because better cleaning is obtained with higher solvent levels, the d-limonene/surfactant/water mixture preferably contains 40–60% d-limonene, 10–30% surfactant, and 20–40% water.

17 Claims, 1 Drawing Figure

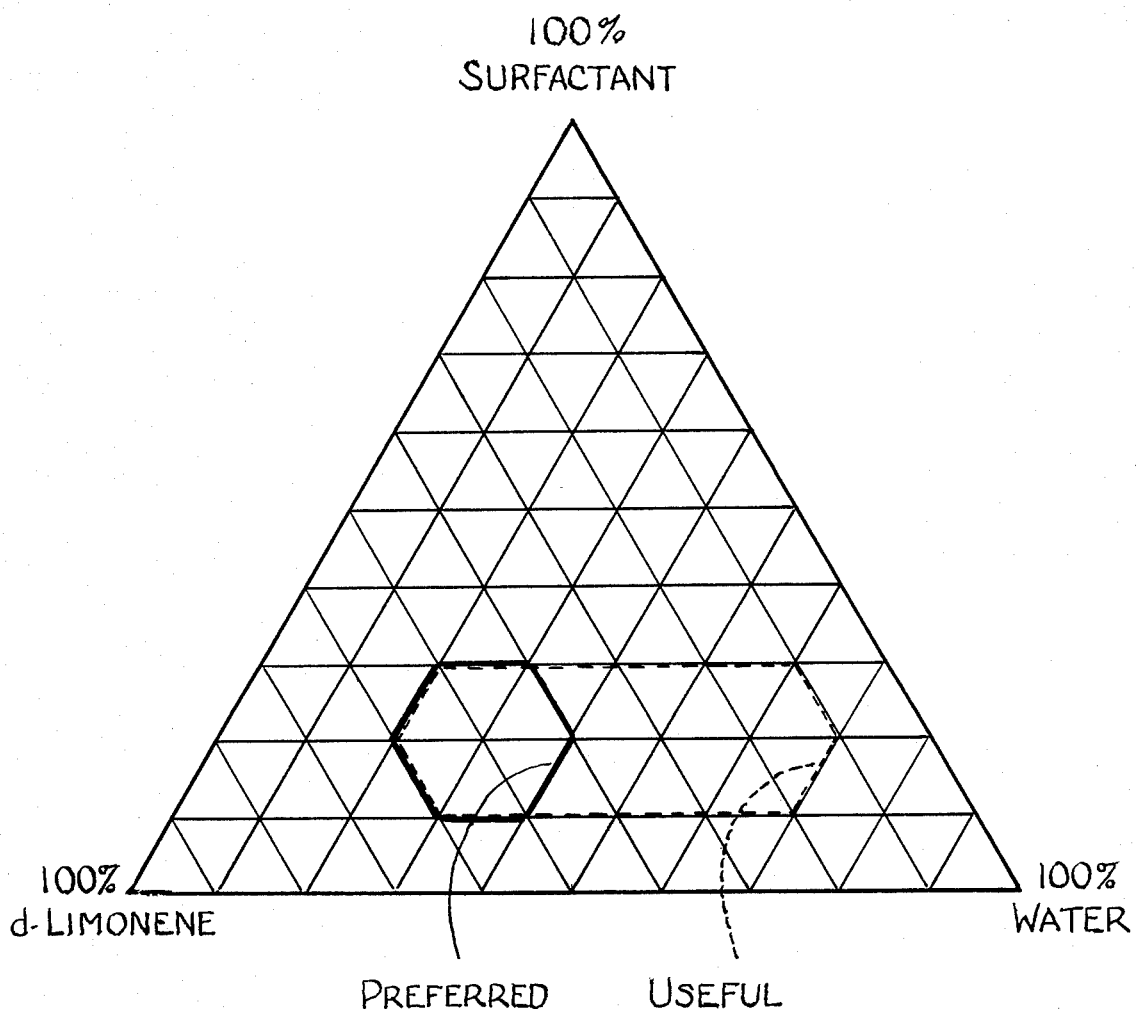
100%
SURFACTANT
100%
d-LIMONENE
100%
WATER
PREFERRED
USEFUL

D-LIMONENE BASED AQUEOUS CLEANING COMPOSITIONS

This invention relates to d-limonene-based aqueous cleaning compositions for hard and/or flexible substrates, wherein the normally water-immiscible d-limonene is stabilized in clear aqueous solution by the combined effect of carefully selected and proportioned surface active agents and a coupling agent, suitably in the form of a glycol or a lower alkyl glycol ether. One or more surfactants can be employed with a glycol or a glycol ether as the coupling agent. Preferred formulations contain selected anionic, nonionic, or mixed anionic-nonionic surfactants. The compositions can also contain small amounts of additives adapting the compositions to particular uses.

Throughout industry there are many situations inherently causing serious cleaning problems. Prime examples are machine shops, automotive service centers, food processing industries and the like, which produce soils involving deposits of one or more of heavy oils, greases, dirt, grime, asphaltum deposits and burned or oxidized films.

It has been customary in the past to employ, in the cleaning of such soils, compositions with petroleum derived or halogenated hydrocarbon solvents or with high levels of caustic and/or phosphates, all of which either are hazardous in use or provide residues which are increasingly troublesome environmental pollutants.

Solvents of the type mentioned above possess several disadvantages. Some of the halogenated hydrocarbon solvents have been shown to affect worker health adversely, so that their use has either been eliminated or drastically curtailed by governmental pressure. Even when they can be and are used, the disposal of spent solvent in accordance with government regulations has become an onerous and expensive problem, especially for the smaller users who must avail themselves, at considerable cost, of the services of commercial disposal firms for this purpose.

Additionally, many of these solvents and compositions derived therefrom, are flammable. This limits their use in situations in which fire and explosion could be potential hazards.

An object of the present invention is to provide effective cleaning compositions, which are free of objectionable petroleum derived or halogenated hydrocarbon solvents and which are useful for industrial cleaning tasks in which accumulations of oily and particular soil must be removed from hard and flexible substrates.

A further object of the invention is to provide stable, flowable, clear, homogeneous, liquid cleaning compositions which are biodegradable, and which maintain their flowability, clarity and homogeneity during long periods of storage and substantial fluctuations in temperature.

A still further object of the invention is to provide stable, flowable, clear, homogeneous liquid compositions useful for heavy industrial cleaning tasks in which safety in use is enhanced by providing a flash point in excess of about 160° F. as measured by the Cleveland Open Cup (C.O.C.) method.

The active cleaning and degreasing solvent component of the new cleaning compositions is d-limonene, a by-product of the citrus industry, derived in various amounts from the rinds or peels of oranges, grapefruits and other citrus fruits. An extensive discussion of d-limonene and its derivation from various sources is presented in a book by J. W. Kesterson, R. Hendrickson and R. J. Braddock entitled "Florida Citrus Oil" and published in December 1971 by Agricultural Experiment Station, Institute of Food & Agricultural Sciences, University of Florida, Gainesville, Fla.

The d-limonene employed in the compositions of the present invention has been obtained from Florida Chemical Co., Inc. of Lake Alfred, Fla., and falls within the following specifications:

D-LIMONENE SPECIFICATIONS (untreated grade)

| Characteristic | Value |
|---|---|
| Flash point, (C.O.C.) | approx. 140° F. |
| Specific gravity 24/24° C. | 0.8433 to 0.8398 |
| Refractive index $D^{20}$ | 1.4721 to 1.4713 |
| Optical rotation $D^{25}$ | +98.90 to +95.55 |
| Aldehyde content | 1.50 to 0.47% |
| Ester content | 2.46 to 0.07% |
| Evaporation residue | 0.79 to 0.03% |

Note:
The d-limonene as commercially supplied is stabilized with about 0.1% of an antioxidant, preferably BHT (butylated hydroxytoluene). The use of the expression "stabilized d-limonene" has reference to d-limonene containing 0.1% of BHT or comparable antioxidant.

The foregoing specifications are generally consistent with the data reported in the above-mentioned book by Kesterson, Hendrickson and Braddock on d-limonene derived from various sources.

A major problem in adapting d-limonene for safe and practical use as an industrial cleaner is to formulate the cleaning composition to provide the highest possible flash point. Preferred compositions in accordance with the present invention improve the flash point to provide readings of at least 160° F. (C.O.C.).

The combination of properties desired in the new cleaning compositions, i.e. the flowable, clear, homogeneous liquid characteristics and a flash point of at least 160° F. (C.O.C.) is provided by combining in proper proportions d-limonene, water, a surface active agent selected from the group consisting of anionic, nonionic and mixed anionic-nonionic surfactants, and a coupling agent, suitably a glycol or a lower alkyl glycol ether.

DESCRIPTION OF DRAWING

Having reference to the attached ternary diagram for the system d-limonene/surfactant/water, the area for the combinations useful in carrying out the present invention, and the more limited area of the combinations preferred in carrying out the present invention, have been depicted; and it will be apparent that they correspond with the ranges:

| Component | Useful range | Preferred range |
|---|---|---|
| d-limonene | 10 to 60% by weight | 40 to 60% by weight |
| surfactant | 10 to 30% by weight | 10 to 30% by weight |
| water | 20 to 70% by weight | 20 to 40% by weight |

Within the useful and preferred areas thus depicted, the three component systems of d-limonene, surfactant and water are unsatisfactory by reason of phase separation, turbidity or viscosity, sometimes approaching gel consistency, until a small amount of coupling agent has been incorporated in the mixture. In this connection it will by noted that three component mixtures in peripheral portions of the diagram may be clear and of fluid consistency without addition of coupling agent, but such mixtures are unsatisfactory for various reasons, i.e. insufficient d-limonene to provide a useful cleaning effect, insufficient water to provide the desired elevation in flash point or excessive surfactant constituting an economic deterrent.

It should further be noted that the coupling agent, such as Butyl Carbitol (Union Carbide brand of diethylene glycol monobutyl ether) or hexylene glycol, by itself has no effect on clarifying d-limonene—water mixtures in the concentration employed. In other words it is the co-acting effect of the surfactant and the coupling agent that makes it possible to obtain, in the useful and preferred areas, products which have the desired flowable, clear, homogeneous liquid characteristics.

It appears that the ability to produce the desired flowable, clear, homogeneous liquid characteristics is peculiar to anionic and nonionic surfactants and mixtures thereof.

Suitable anionic surfactants, when used as the only surfactant, include salts of higher alkyl aryl sulfonates, with preferred anionics being the alkali metal and amine salts of dodecylbenzene sulfonic acid.

Suitable nonionic surfactants, when used as the only surfactant, include condensates of hydrophobic moieties condensed with polymeric lower alkylene oxides, with a preferred type nonionic being alkylphenol ethylene oxide condensates containing 4 to 15 moles of ethylene oxide. Particularly good results are obtained with nonylphenol ethylene oxide condensates containing about 9.5 moles of ethylene oxide.

In systems containing both anionic and nonionic surfactants it is possible, in addition to mixtures of the above-mentioned anionic and nonionic surfactants, to employ mixtures of the above-mentioned nonionics with anionics which are alkali metal or amine salts of fatty acids such as tall oil fatty acid and oleic acid.

When the system contains both anionic and nonionic surfactants, the relative proportions thereof can be widely varied, but the combined amount of mixed surfactants will provide the earlier indicated 10 to 30% by weight of surfactant in the d-limonene/surfactant/water mixture.

In preparing the industrial cleaning compositions of the present invention intended for heavy industrial cleaning, and in anticipating special problems of surfaces to be treated such as the alkali sensitivity of exposed aluminum surfaces, and environmental variations such as hardness of water to be used in rinsing, the compositions can be formulated with selected additives to meet the particular operational requirements. Such additives can include, inter alia, water softening agents, builders including phosphate salts, such as alkali tripolyphosphate or tetrapyrophosphate, sodium metasilicate (as a corrosion inhibitor) and organic sequestrants such as EDTA (ethylenediamine tetraacetic acid) tetrasodium salt. The combined amounts of such additives can vary from about 2 to 12% by weight of the composition.

In formulating cleaning compositions in accordance with the present invention it appears that three component systems of d-limonene, surfactant and water, as enhanced by the presence of coupling agent, are not adversely affected by additives of the type mentioned in appropriate amounts. It is possible, however, that excessive amounts of a particular additive could impair the desired clarity and stability, in which event the amount of the particular additive can be reduced to a satisfactory level.

The manner of using the new cleaning compositions can vary widely according to the soil condition to be cleaned. Application can, for example, be by brush, swab, spray, pressure hosing, dipping, etc. For difficult soils, with heavy deposits of grease and other soils, the compositions are best used undiluted; but when the conditions are less severe, the compositions can be diluted with water in appropriate amounts up to about one part composition to 100 parts water.

An interesting phenomenon is use of the new compositions, particularly as used undiluted, or with water added to provide about 1 to 10 dilutions, is that greasy soil will remain solubilized while the cleaning mixture is agitated, but will separate as an upper oily layer upon standing, while any suspended particles will settle in a bottom layer.

The intermediate "cleaning solution" layer which separates upon standing shows relatively little loss in its d-limonene content. This layer can thus be re-used for further cleaning operations. The greasy upper layer can be skimmed off and the precipitated solids can simply be discarded.

This adapts the compositions for use in a "recycling system" cleaning operation in which parts contaminated with greasy soil can be cleaned in an "agitation station", the soil components separated at a "settling station" and the cleaning compositions can be periodically recycled between the two stations.

The novel cleaning compositions of the present invention will be more fully understood from a consideration of the following examples illustrating preferred embodiments. It is to be understood, however, that these examples are given by way of illustration and not of limitation.

EXAMPLE 1

An industrial cleaning composition is prepared containing by weight:

| | % |
|---|---|
| Water | 44.8 |
| Stabilized d-Limonene | 35.1 |
| Potassium salt of dodecylbenzene sulfonic acid | 11.4 |
| Tetrapotassium pyrophosphate | 2.2 |
| Butyl Carbitol | 6.0 |
| Sodium metasilicate | 0.5 |

This is a heavy duty industrial cleaner appropriate for use in environments containing aluminum surfaces. It has a flash point of about 160°-165° F. (C.O.C.)

EXAMPLE 2

A heavy duty industrial cleaning composition is prepared containing by weight:

| | % |
|---|---|
| Water | 32.2 |
| EDTA tetrasodium salt (38%) | 4.2 |
| Nonylphenol with 9.5 moles of ethylene oxide | 5.2 |
| Dodecylbenzene sulfonic acid | 9.9 |
| Stabilized d-Limonene | 36.9 |
| Butyl Carbitol | 6.3 |
| Monoethanolamine | 5.3 |

This cleaning composition, which is free of phosphates is environmentally desirable. The composition has a flash point of 160°-165° F. (C.O.C.).

EXAMPLE 3

A medium duty industrial cleaner is prepared containing by weight:

| | % |
|---|---|
| Water | 68.6 |
| Potassium salt of dodecylbenzene sulfonic acid | 9.3 |
| Nonylphenol ethoxylate with 9.5 moles ethylene oxide | 4.2 |
| EDTA tetrasodium salt (38%) | 0.4 |
| Butyl Carbitol | 4.2 |
| Stabilized d-Limonene | 12.5 |
| Sodium metasilicate | 0.8 |

This composition, which contains substantially less d-limonene than Examples 1 and 2, is appropriate for cleaning situations involving light soils. It shows no flash point as determined by the C.O.C. method.

EXAMPLE 4

A heavy duty industrial cleaner is prepared containing by weight:

| | % |
|---|---|
| Water | 36.05 |
| EDTA tetrasodiumsalt (38%) | 1.75 |
| Monoethanolamine | 5.8 |
| Nonylphenol with 15 moles of ethylene oxide | 5.7 |
| Dodecylbenzenesulfonic acid | 10.8 |
| Butyl Carbitol | 7.1 |
| Stabilized d-Limonene | 32.8 |

The above formula provides satisfactory product stability, satisfactory cleaning, and has a flash point of 160° F. (C.O.C.).

EXAMPLE 5

A heavy duty industrial cleaner is prepared containing by weight:

| | % |
|---|---|
| Water | 38.9 |
| EDTA tetrasodium salt (38%) | 2.2 |
| Monoethanolamine | 7.4 |
| Nonylphenol with 4 moles ethylene oxide | 7.2 |
| Dodecylbenzene sulfonic acid | 13.7 |
| Butyl Carbitol | 2.8 |
| Stabilized d-Limonene | 27.8 |

The above formula is stable, provides satisfactory cleaning, and has a flash point of 160° F. (C.O.C.).

EXAMPLE 6

A heavy duty industrial cleaner is prepared containing by weight:

| | % |
|---|---|
| Water | 33.45 |
| EDTA tetrasodium salt (38%) | 1.75 |
| Monoethanolamine | 3.9 |
| Nonylphenol with 9.5 moles ethylene oxide | 6.7 |
| Tall oil fatty acid (4% rosin) | 10.0 |
| Dipropylene glycol | 11.1 |
| Stabilized d-Limonene | 33.1 |

This formula provides satisfactory product stability, cleaning capability, and has a flash point in excess of 160° F. (C.O.C.).

EXAMPLE 7

A medium duty industrial cleaner is prepared containing:

| | % Wt |
|---|---|
| Water | 42.3 |
| EDTA Tetrasodium salt (38%) | 1.0 |
| Nonylphenol with 9.5 moles of ethylene oxide | 25.0 |
| Butyl carbitol | 12.5 |
| Stabilized d-Limonene | 19.2 |

This formula provides a flash point of 165° F. (C.O.C.) and has satisfactory stability and cleaning capability.

EXAMPLE 8

A medium duty industrial cleaner is prepared containing:

| | % Wt |
|---|---|
| Water | 52.1 |
| Nonylphenol with 9.5 moles ethylene oxide | 20.7 |
| Hexylene glycol | 10.0 |
| Stabilized d-Limonene | 13.2 |
| EDTA, sodium salt (38%) | 2.7 |
| Sodium silicate, 47% solution | 1.3 |

This is a stable product with good cleaning capability, and has a flash point of 165° F. (C.O.C.).

EXAMPLE 9

A medium duty industrial cleaner is prepared containing:

| | % Wt |
|---|---|
| Water | 54.9 |
| Nonylphenol with 9.5 moles of ethylene oxide | 12.2 |
| Potassium salt of oleic acid | 8.7 |
| Butyl carbitol | 11.9 |
| Stabilized d-Limonene | 10.5 |
| EDTA Tetrasodium salt (38%) | 0.9 |
| Sodium silicate 47% solution | 0.9 |

This product is stable, has good cleaning capability, and has a flash point in excess of 185° F. (C.O.C.).

The key to obtaining the desired combination of stability, cleaning power and satisfactory flash point appears to critically depend on the proper selection and relative amounts of components of the d-limonene/surfactant/water system and the proper selection and amount of coupling agent. It has been found, for example, that alcohols such as isopropanol are effective coupling agents from the standpoint of stability and cleaning power, but that in amounts to be effective they adversely affect the flash point yielding compositions with flash points substantially lower than 160° F. (C.O.C.).

It is believed that the variations shown in the foregoing examples provide an effective guide to those interested in utilizing the new d-limonene based cleaning compositions for the varied, and frequently difficult, cleaning needs encountered in industry.

Various changes and modifications in the industrial cleaning compositions herein disclosed may occur to those skilled in the art; and to the extent that such changes and modifications are embraced by the appended claims, it is to be understood that they constitute part of the present invention.

I claim:

1. A d-limonene based liquid cleaning composition for cleaning hard or flexible substrates, said composition, per 100 parts by weight, comprising 78 to 96 parts by weight of a d-limonene/surfactant/water mixture containing by weight 10–60% stabilized d-limonene, 10–30% surfactant and 20–70% water, 2–10 parts of coupling agent, and 2–12 parts of additives adapting the composition to particular uses, said composition being characterized as being free of petroleum derived or chlorinated hydrocarbon solvents, as having a flash point not lower than 160° F. (C.O.C.), and as being a stable, flowable, clear, homogeneous liquid composition.

2. A d-limonene-based heavy duty cleaning composition as defined in claim 1, wherein said d-limonene/surfactant/water mixture contains by weight 40–60% stabilized d-limonene, 10–30% surfactant and 20–40% water.

3. A d-limonene-based cleaning composition as defined in claim 1, wherein said surfactant is selected from the group consisting of anionic and nonionic surfactants, and mixtures thereof.

4. A d-limonene-based cleaning composition as defined in claim 3, wherein the anionic surfactant is a salt of a higher alkylaryl sulfonate.

5. A d-limonene-based cleaning composition as defined in claim 4, wherein the anionic surfactant is an alkali metal or amine salt of dodecylbenzene sulfonic acid.

6. A d-limonene-based cleaning composition as defined in claim 3, wherein the nonionic surfactant is an alkylphenol ethylene oxide condensate containing 4 to 15 moles of ethylene oxide.

7. A d-limonene based cleaning composition as defined in claim 6, wherein the nonionic surfactant is a nonylphenol ethylene oxide condensate containing about 9.5 moles of ethylene oxide.

8. A d-limonene based cleaning composition as defined in claim 3, wherein the surfactant is a mixture of a nonionic surfactant in the form of an alkylphenol ethylene oxide condensate containing 4 to 15 moles of ethylene oxide, and an anionic surfactant in the form of an alkali metal or amine salt of a higher alkylaryl sulfonate.

9. A d-limonene based cleaning composition as defined in claim 8, wherein the alkylphenol ethylene oxide condensate is nonylphenol containing about 9.5 moles of ethylene oxide and the sulfonate is an alkyli metal or amine salt of dodecylbenzene sulfonic acid.

10. A d-limonene based cleaning composition as defined in claim 3, wherein the surfactant is a mixture of a nonionic surfactant in the form of an alkylphenol ethylene oxide condensate containing 4 to 15 moles of ethylene oxide, and the anionic surfactant is in the form of an alkali metal or amine salt of a fatty acid.

11. A d-limonene based cleaning composition as defined in claim 10, wherein the alkylphenol ethylene oxide condensate is nonylphenol containing about 4 to 15 moles of ethylene oxide, and the fatty acid salt is an alkali metal or amine salt of tall oil fatty acid.

12. A d-limonene based cleaning composition as defined in claim 10, wherein the alkylphenol ethylene oxide condensate is nonylphenol containing about 4 to 15 moles of ethylene oxide, and the fatty acid salt is an alkali metal of amine salt of oleic acid.

13. A d-limonene based cleaning composition as defined in claim 1, wherein the coupling agent is selected from the group consisting of glycols and lower alkyl glycol ethers.

14. A d-limonene based cleaning composition as defined in claim 13, wherein the coupling agent is Butyl Carbitol.

15. A d-limonene based cleaning composition as defined in claim 13, wherein the coupling agent is hexylene glycol.

16. A d-limonene based cleaning composition as defined in claim 13, wherein the coupling agent is dipropylene glycol.

17. A d-limonene based cleaning composition as defined in claim 1, wherein the additive adapting the composition to particular uses is selected from the group consisting of water softening agents, sequestrants, builders and corrosion inhibitors.

* * * * *

REEXAMINATION CERTIFICATE (1350th)

United States Patent [19]

Matta

[11] B1 4,511,488

[45] Certificate Issued Sep. 11, 1990

[54] D-LIMONENE BASED AQUEOUS CLEANING COMPOSITIONS

[75] Inventor: Grant B. Matta, Dover, N.J.

[73] Assignee: Penetone Corp., Tenafly, N.J.

Reexamination Request:
No. 90/001,808, Jul. 10, 1989

Reexamination Certificate for:

| | |
|---|---|
| Patent No.: | **4,511,488** |
| Issued: | **Apr. 16, 1985** |
| Appl. No.: | **558,040** |
| Filed: | **Dec. 5, 1983** |

[51] Int. Cl.[5] ..... C11D 7/24; C11D 3/18

[52] U.S. Cl. ..... 252/162; 252/118; 252/171; 252/174.21; 252/558; 252/DIG. 14

[58] Field of Search ..... 252/118, 171, 174.21, 252/558, 162

[56] References Cited

U.S. PATENT DOCUMENTS

| | | | |
|---|---|---|---|
| 4,414,128 | 11/1983 | Goffinet | 252/111 |
| 4,540,505 | 9/1985 | Frazier | 252/106 |

FOREIGN PATENT DOCUMENTS

| | | |
|---|---|---|
| 80749 | 6/1983 | European Pat. Off. . |
| 51794 | 3/1985 | Japan . |
| 1603047 | 11/1981 | United Kingdom . |

*Primary Examiner*—Prince E. Willis, Jr.

[57] ABSTRACT

D-Limonene-based aqueous cleaning compositions for hard and/or flexible substrates are provided wherein the normally water-immiscible d-limonene is stabilized in clear aqueous solution by the combined effect of carefully selected and proportioned surface active agents, and a coupling agent, suitably in the form of a glycol or a lower alkyl glycol ether. One or more surfactants can be employed with a glycol or glycol ether as the coupling agent. Preferred formulations contain selected anionic, nonionic, or mixed anionic-nonionic surfactants. The compositions can also contain small amounts of additives adapting the compositions to particular uses. The new cleaning compositions contain by weight, 78 to 96 parts of a d-limonene/surfactant/water mixture containing 10–60% d-limonene, 10–30% surfactant, and 20–70% water, coupling agent in the amount of 2–10 parts by weight, and 2–12 parts of additives adapting the compositions to particular uses. Because better cleaning is obtained with higher solvent levels, the d-limonene/surfactant/water mixture preferably contains 40–60% d-limonene, 10–30% surfactant, and 20–40% water.

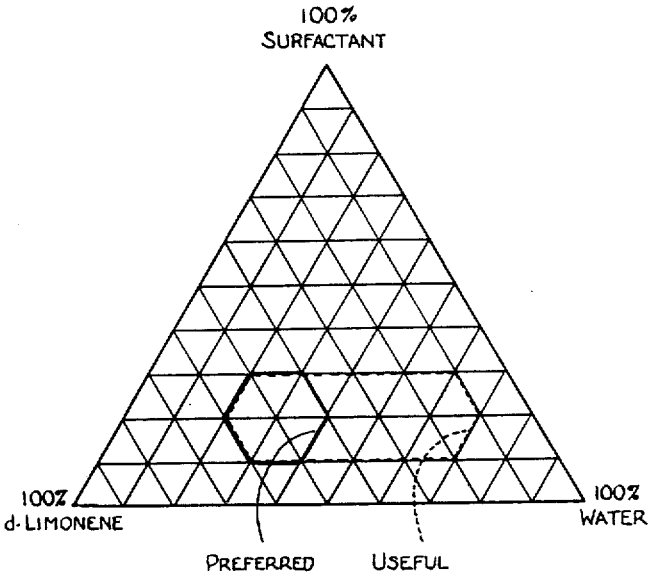

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–17 is confirmed.

New claim 18 is added and determined to be patentable.

*18. A d-limonene-based liquid cleaning composition for cleaning hard or flexible substrates, said composition, per 100 parts by weight, comprising 78–96 parts by weight, of a d-limonene/surfactant/water mixture containing by weight 13.21–60% stabilized d-limonene, 10–30% surfactant and 20–70% water, 2–10 parts of coupling agent, and 2–12 parts of additives adapting the composition to particular uses, said composition being characterized as being free of petroleum-derived or chlorinated hydrocarbon solvents, as having a flash point not lower than 160° F. (C.O.C.), and as being a stable, flowable, clear, homogeneous liquid composition.*

* * * * *